US011840889B2

(12) United States Patent
Sterling, Jr.

(10) Patent No.: US 11,840,889 B2
(45) Date of Patent: Dec. 12, 2023

(54) SELF LEVELING ONE GALLON PAINT CAN HOLDER-EXTENSION LADDER ATTACHMENT

(71) Applicant: Johnnie Sterling, Jr., Licking, MO (US)

(72) Inventor: Johnnie Sterling, Jr., Licking, MO (US)

( * ) Notice: Subject to any disclaimer, the term of this patent is extended or adjusted under 35 U.S.C. 154(b) by 0 days.

(21) Appl. No.: 17/300,568

(22) Filed: Aug. 23, 2021

(65) Prior Publication Data

US 2023/0057281 A1 Feb. 23, 2023

(51) Int. Cl.
*E06C 7/14* (2006.01)

(52) U.S. Cl.
CPC ..... *E06C 7/14* (2013.01)

(58) Field of Classification Search
CPC ..... E06C 7/14; E06C 7/146; B44D 3/14
USPC ..... 248/210–211, 238, 312.1, 311.2; 182/121
See application file for complete search history.

(56) References Cited

U.S. PATENT DOCUMENTS 1,221,658 A * 4/1917 Berry ..... E06C 7/14 248/210
1,772,392 A * 8/1930 Firl ..... B44D 3/14 248/210
2,883,134 A * 4/1959 O'Halloran ..... E06C 7/14 248/210
3,001,751 A * 9/1961 Bozik ..... E06C 7/14 248/210
3,051,428 A * 8/1962 Schult ..... E06C 7/146 248/231.51
3,511,338 A * 5/1970 Chapman ..... E06C 7/16 182/121
3,738,601 A * 6/1973 Gehringer ..... E06C 7/14 248/912
3,895,772 A * 7/1975 Ellingson ..... E06C 7/14 248/210
3,987,993 A * 10/1976 Hopkins ..... E06C 7/14 248/210
4,013,251 A * 3/1977 Cleveland ..... E06C 7/14 248/210
4,036,463 A * 7/1977 Hopkins ..... B44D 3/123 248/210
4,211,307 A * 7/1980 Ethridge ..... E06C 7/16 182/121
4,386,753 A * 6/1983 Smith ..... E06C 7/14 248/210
4,534,528 A * 8/1985 Rousseau ..... E06C 7/14 248/210
4,560,127 A * 12/1985 Ippolito ..... E06C 7/14 248/210
D296,268 S * 6/1988 Bozarth ..... D3/229
4,787,586 A * 11/1988 Crain ..... E06C 7/14 248/210

(Continued)

*Primary Examiner* — Ingrid M Weinhold

(57) ABSTRACT

This invention is specifically, useful in the field of home improvement necessities, serving a painters need without frustrations when the use of an extension ladder is necessary. This invention is made to be attached to a extension ladder. The inventions circular grooved cylinder is fashioned to hold a one gallon paint can within the cylinder and the grooves. The cylinder is mounted specifically for the can to tilt backwards and forward when attached to the ladder keeping the paint can level.

8 Claims, 9 Drawing Sheets

(56) References Cited

U.S. PATENT DOCUMENTS

| | | | | |
|---|---|---|---|---|
| 5,052,581 | A * | 10/1991 | Christ | E06C 7/14 220/570 |
| 7,967,264 | B1 * | 6/2011 | Peterson | E06C 7/143 182/115 |
| 8,365,863 | B2 * | 2/2013 | Astor | E06C 7/14 248/238 |
| 9,353,571 | B2 * | 5/2016 | Coe | E06C 7/14 |
| 10,718,120 | B1 * | 7/2020 | Haney | E04G 5/003 |
| 2007/0181761 | A1 * | 8/2007 | Astor | E06C 7/14 248/238 |
| 2008/0053751 | A1 * | 3/2008 | Meyers | E06C 7/16 182/121 |
| 2013/0220951 | A1 * | 8/2013 | Dufour | E06C 7/14 211/13.1 |
| 2016/0024845 | A1 * | 1/2016 | Coe | E06C 7/14 220/737 |
| 2017/0191312 | A1 * | 7/2017 | Durbin, Jr. | E06C 7/143 |

* cited by examiner

FIGURE 4A
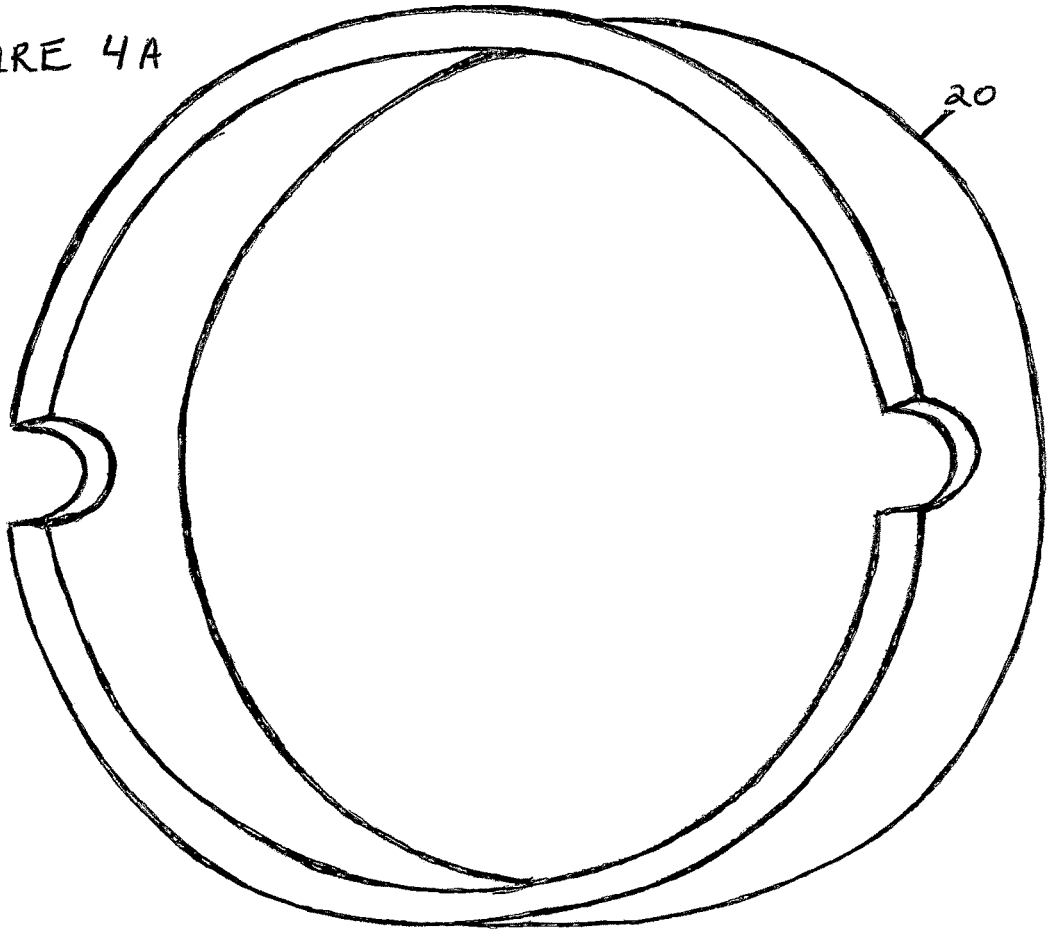
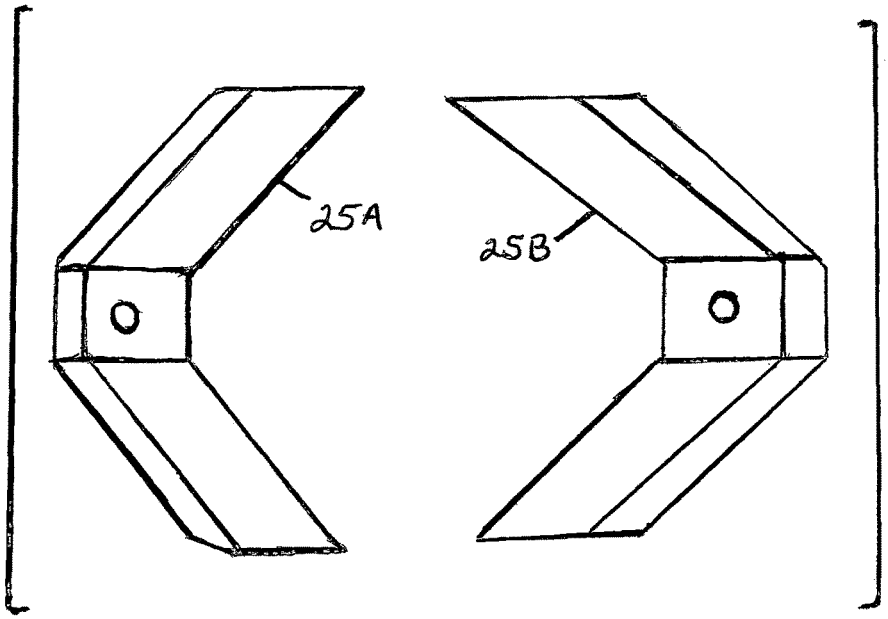
FIGURE 4B

FIGURE 5A
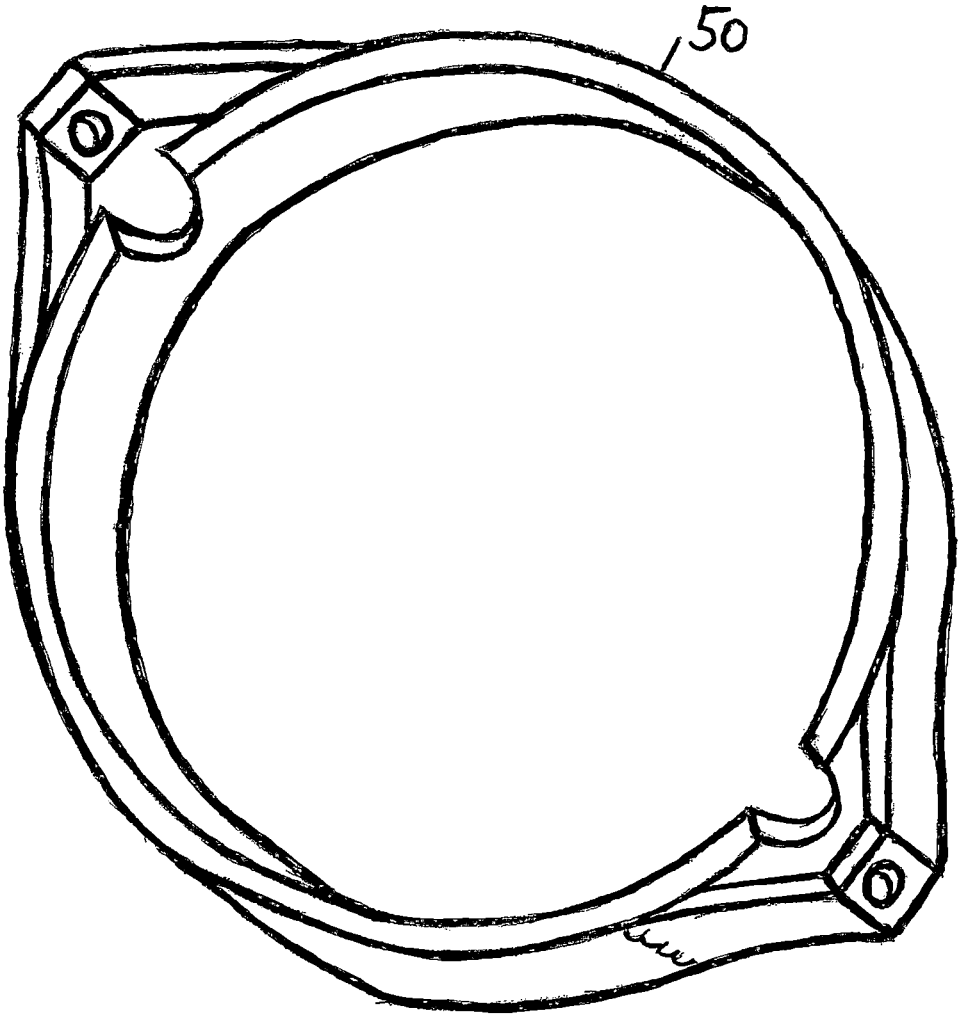
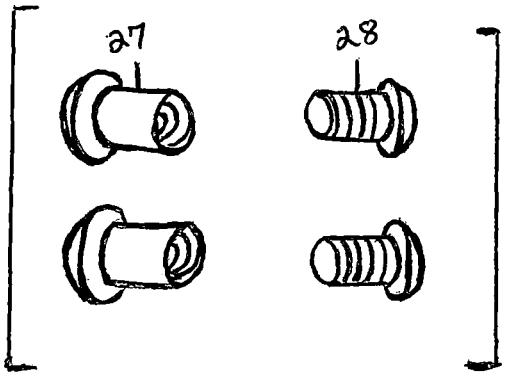
FIGURE 5B

FIGURE 8 A
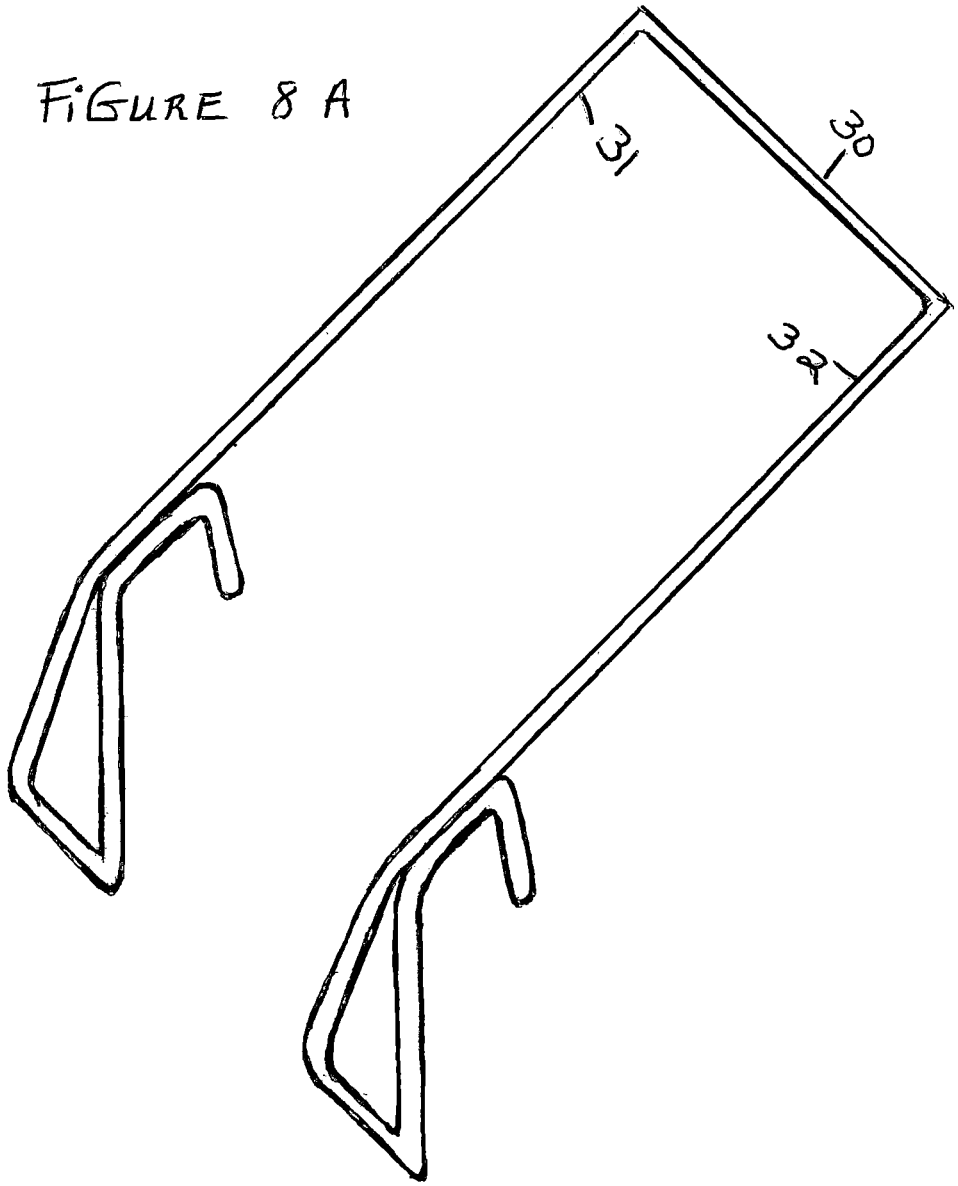
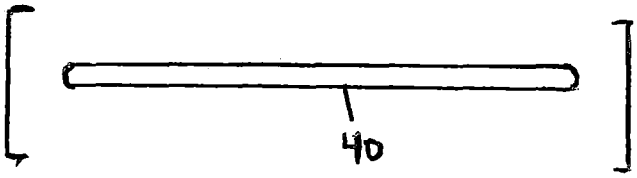
FIGURE 8B

SELF LEVELING ONE GALLON PAINT CAN HOLDER-EXTENSION LADDER ATTACHMENT

BACKGROUND OF THE INVENTION

The field of endeavor to which this invention pertains is defined under the United States Patent Office classification definition as a "machine." This invention makes it easy to secure the gallon paint can while high upon an extension ladder. In the past unlike the small unfolding step ladder, the extension ladder did not have a stable platform for holding a gallon paint can. In fact the norm for keeping a gallon paint can up on the extension ladder up until now was with an S shaded fashioned wire. This S shaded wire or hanger formed into an S had to be durable in strength to hold on to the stair and gallon can handle. This gallon paint can handle made it difficult to easily dip a paint brush for more paint to be put onto the brush.

BRIEF SUMMARY OF THE INVENTION

The self leveling one gallon paint can holder-extension ladder attachment is conveniently USEFUL, safe and A NEW simple way of painting from the one gallon paint can while up high on a extension ladder. The one gallon paint can and it's contents self levels because of the circular fashioned aluminum cylinder that swivels and is made on this extension ladder attachment. This attachment resolves the problem of the gallon paint can handle obscuring the dipping of the paint brush for more paint. This is a NOVEL invention and contributes to the field of home improvement necessities, making it NON-OBVIOUS.

BRIEF DESCRIPTION OF THE SEVERAL VIEWS OF THE DRAWINGS

FIG. 4A shows a view of the fashioned aluminum cylinder (with side mount assembly's not welded) prior to the side mounts being welded thereto.

FIG. 4B shows a view of the side mounts prior to being welded to the fashioned aluminum cylinder.

FIG. 5A shows a view of the fashioned aluminum cylinder with side mount assembly's welded, with a view of binding post and binding screws needed for assembling the structure depicted in FIG. 5A and FIG. 3 together as depicted in FIG. 6.

FIG. 5B shows two binding posts and two binding screws needed for assembling the aluminum folded sheet depicted in FIG. 7 and the welded assembly depicted in FIG. 5A both together.

FIG. 8A shows a view of the fashioned 5/16 inch HIGH-STRENGTH-STEEL or CAST STEEL Rod not cold rolled.

FIG. 8B shows a view of a 5/16 inch support rod prior to being welded between the two substantially parallel fashioned segments of Figure SA.

FIG. 10 shows an overall view of the invention (completed, attached) assembled and ready for use on an extension ladder.

DETAILED DESCRIPTION OF THE INVENTION

Figure 1:
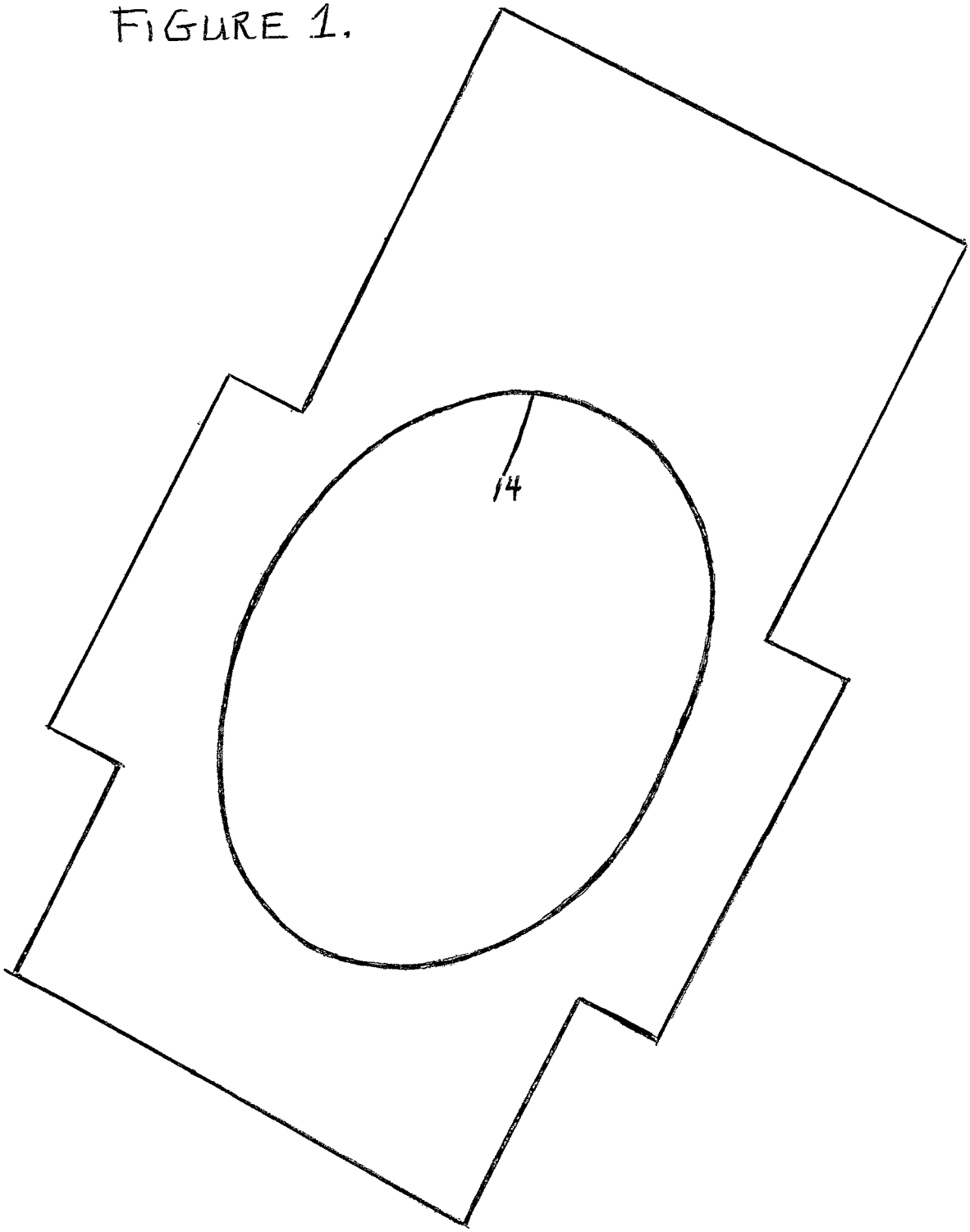
FIG. 1 shows a top surface view without the fashioned front curl, side and end folds completed, but shows the oval shape circumference hole cut out.
Figure 2:
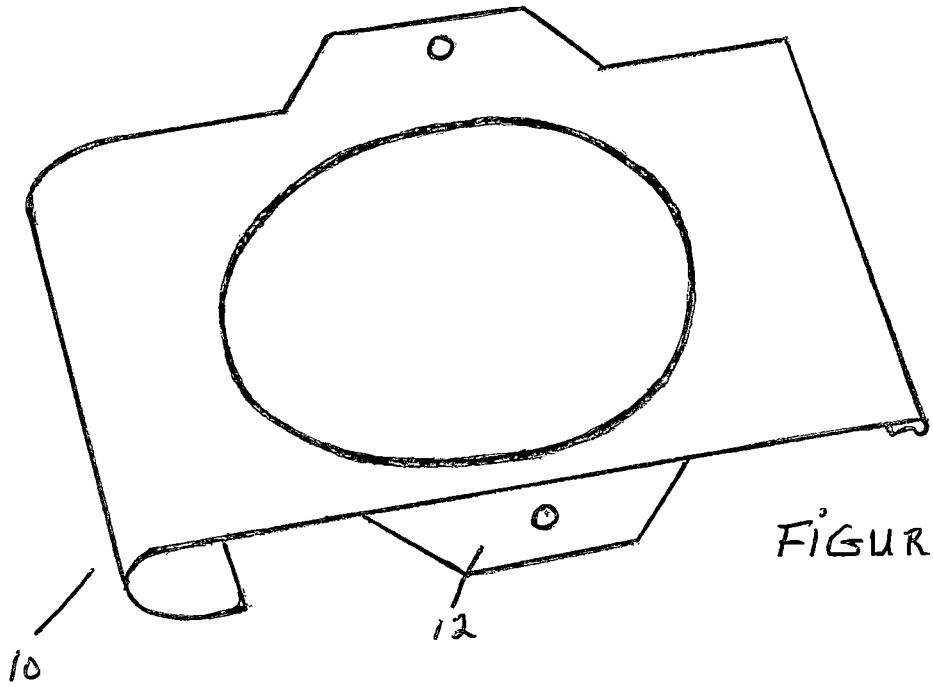
FIG. 2 shows a top surface view with fashioned curl, sides and end folds complete facing left.
Figure 9:
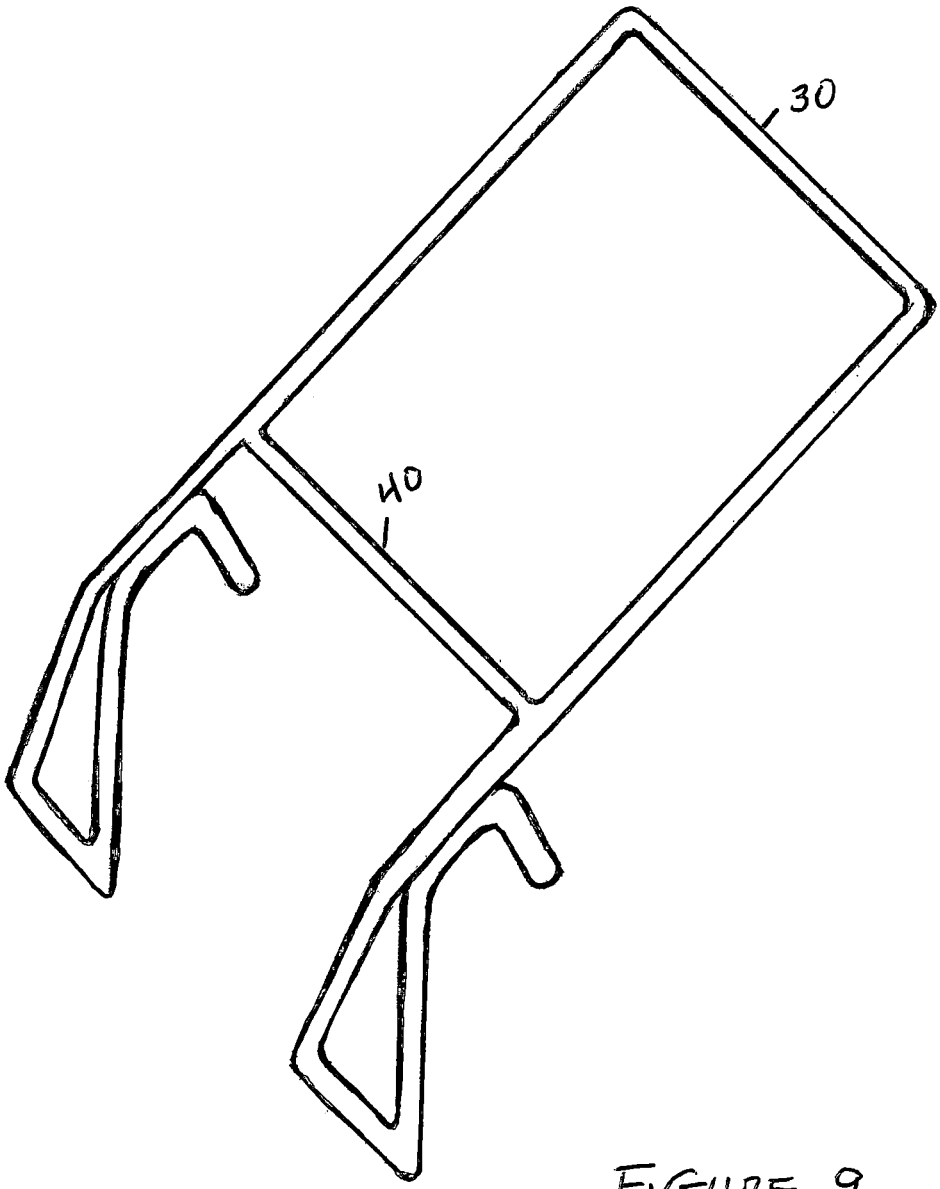
FIG. 9 shows a view of the support rod in FIG. 9B having been assembled to the structure depicted in FIG. 8A.
Figure 10:
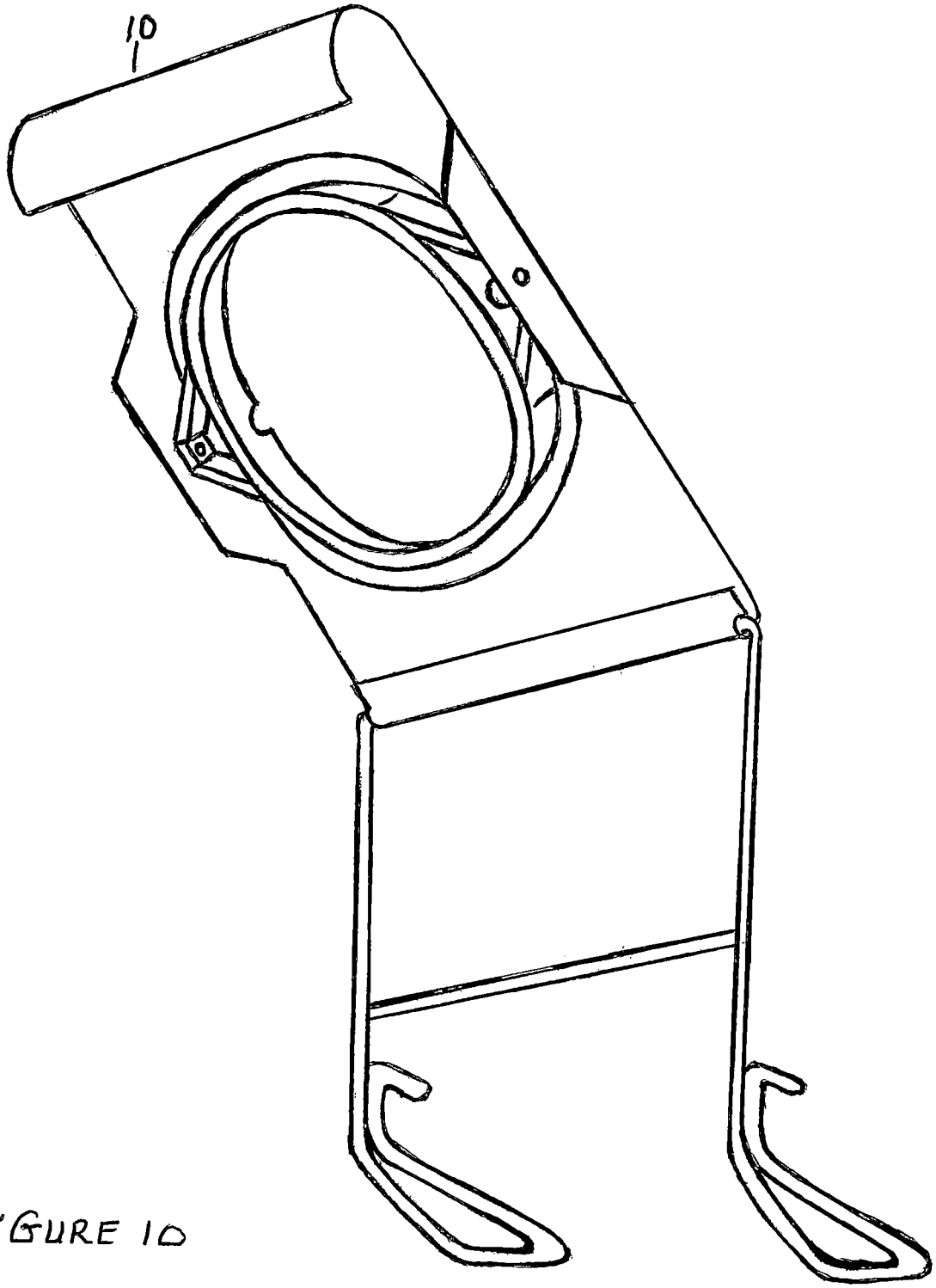
FIG. 10 shows a view of the assembled 5/16 inch fashioned HIGH-STRENGTH-STEEL or CAST-STEEL rod attached to the end fold, completion of the invention is comprised with assembly of FIG. 1 through 10.
Figure 11:
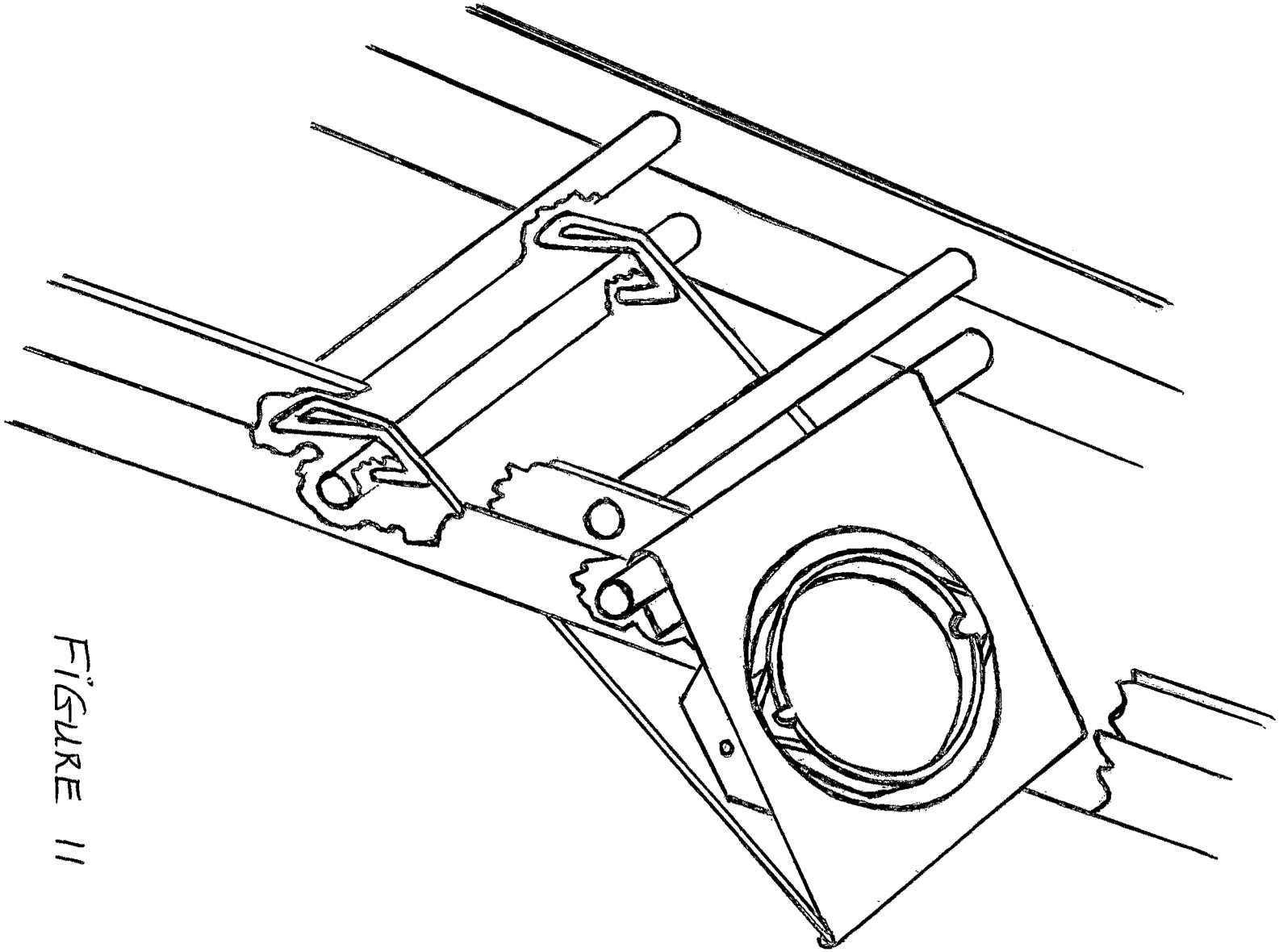
FIG. 11, shows the invention completely assembled and mounted to an extension ladder.

This invention is made in three sections, namely a folded sheet (10) as depicted in FIG. 2, a cylinder (20) with welded side mounts (25A, 25B) as depicted in FIG. 5A, and a U-shaped frame (30) with folded ends and a welded support rod (40) as depicted in FIG. 9. The cylinder (20) depicted in FIG. 4A requires adding two welded side mounts (25A, 25B) depicted in FIG. 4B to complete the fashioned circular shaped cylinder (50) depicted in FIG. 5A. The fashioned shapes cylinder (50), is the attached securely to the folded sheet (10) depicted in FIG. 2, by binding post (27) and binding screws (28) depicted in FIG. 5B, and result in the assembly (60) depicted in FIGS. 6 and 7. The sheet (10), the cylinder (20), and the side mounts (25A, 25B) are all made of aluminum. The U-shaped frame (30) depicted in FIG. 8A and its support rod (40) depicted in FIG. 8B are made of 5/16 inch HIGH-STRENGTH-STEEL, not cold rolled. FIG. 1 shows an oval shaped circumference cut out (14).

To begin making this invention you need a sheet of aluminum 16 inches by 12½ inches and 3/16 inches thick. Steps to cut out the 26 inch oval shaped circumference is to first draw an oval shaped circumference and make it exactly 8¾ inches top to bottom to get a fair idea while shaping it from the bottom. Make a measurement of 6¼ inches from the 12½ inch width of this material and make it your center mark to begin your cut. This 6¼ inch center mark should begin center including a measurement of 2½ inches from the length of the material at the end of the 16 inch length.

A drawn oval circumference, lay on the material before cutting. Now begin at the 6¼ inch center mark made of the width and the 2½ inch center made from the end length. This should leave 3 inches on each side of the material width. These 3 inches that remain on each side of the aluminum will allow room for folds on each side.

Figure 3:
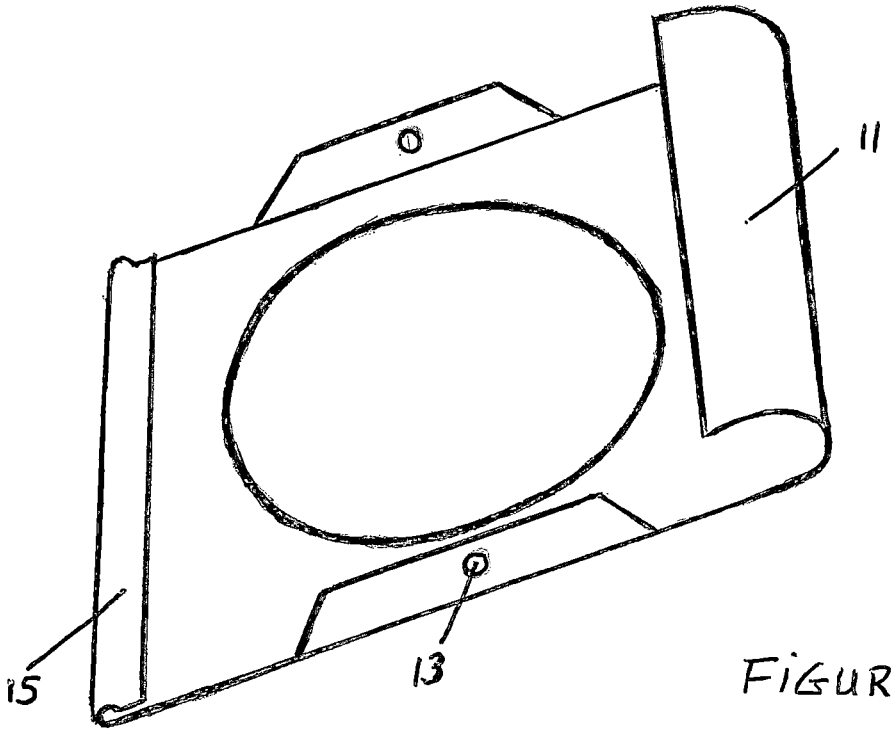
FIG. 3 shows a bottom view with fashioned curl, sides and end folds complete facing right.

Steps to cut out the fold tabs (12) start from the back end, in FIG. 3, where the oval shape cut (14) begins its 2½ inch center point. From this back end measure up towards the front opposite end a 2¾ inch length, then 1¾ inches from the width at the corner and cut off the material. Repeat this 1¾ inch by 1¾ inch square cut on the opposite back corner. To cut the front end folds on each side, measure 8 inches from the length to the back end and cut this measurement off. Repeat this same 8 inch by 1¾ inch removal of the material on the opposite front side of the front end of this aluminum material.

Before bending the fold tabs (12) in the down position the measurements of the folds on each side should be 7¼ inches. Once each side is precisely cut to measurement further cuts on the folds can be made. Now cut ½ inch off on each end of the fold in an upwards oblique angled position. This will leave the top of the fold that will bend down 7¼ inches in length and the bottom 6¼ inches in length from the ½ inch oblique angled cut. Repeat these measured angled cuts of ½ inch on the opposite side fold. About 3⅝ inches center of the 7¼ length fold and 1 inch down from the top of each fold, drill a ⅝ inch hole through each side fold.

Steps to make the front fashioned curl (11) is to measure 4 1/16 inches from the 16 inch length front end. To make the first curl, fold the aluminum material 1½ inches vertically down. Next for the completion curl, fold the aluminum horizontally backwards 2½ inches towards the opposite back end length of the material. Once the front fashioned curl (11) is complete, the top oval circumference opening cut (14) should be a distance of 2¾ inches from the first bend downward front end fold or curl.

The structure depicted in FIG. 4A is made of a 1 inch wide, 20 inch long and 3/16 inch thick aluminum strip, that is to be fashioned into a circular shaped cylinder. When this 20 inch circumference is finished it should be welded together to make the circled cylinder (20). Then smooth out the rough welded area. Next a ⅝ inch half circular grooves should be cut out directly across one side from the other on this circular cylinder top edge. These ⅝ inch grooves are fashioned so the one gallon paint can handle attachment will rest in these grooves.

FIG. 4B has two separate slightly angled fashioned aluminum mounts (25A,25B) made with the same 3/16 inch thickness and same 1 inch width as the FIG. 4A fashioned circular aluminum cylinder (20). See FIG. 5A for view of these two side mount attachments. Once these two side mounts are fashioned, they too must have a ⅝ inch hole drilled in the center of each mount. Each mount (25A,25B) in FIG. 5B is then welded to the side of the cylinder (20), where the ⅝ inch half circular cut out grooves are, as shown in FIG. 5A directly across each other.

Figure 6:
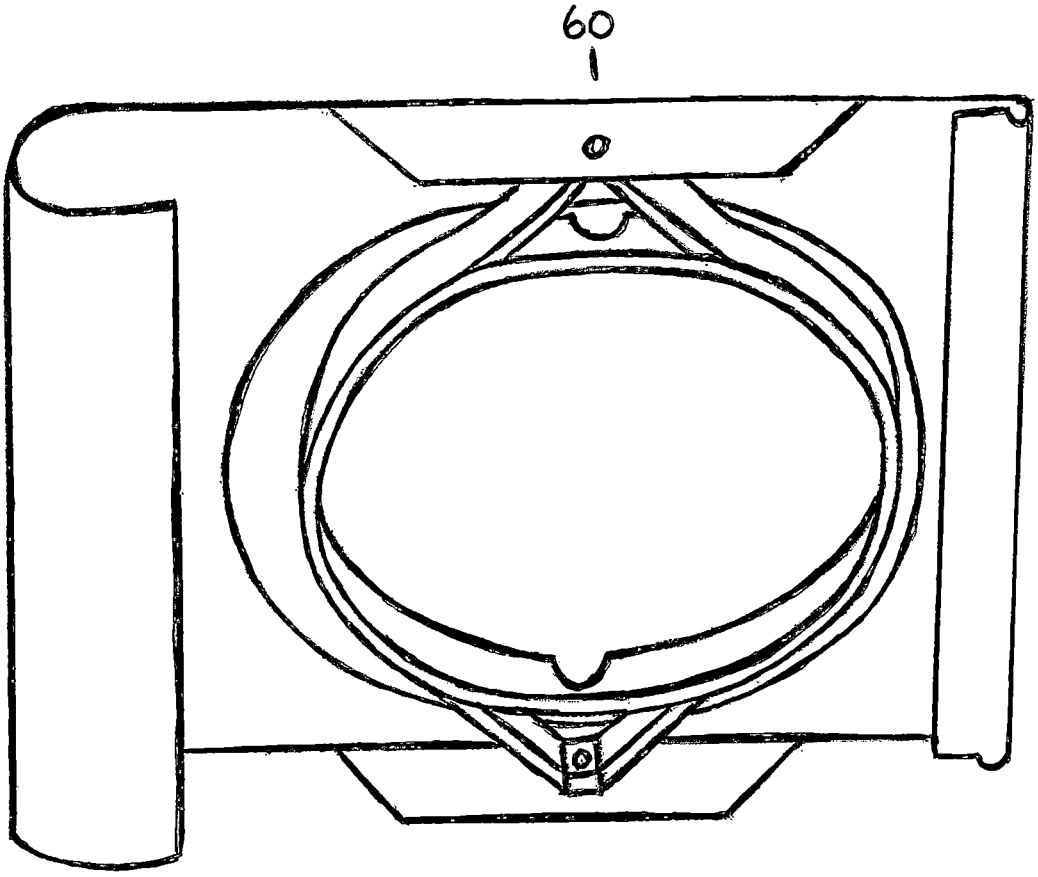
FIG. 6 shows a view of FIG. 5A, fashioned aluminum cylinder assembled to both the bottom of the structure depicted in FIG. 3 secured with binding post and binding screws.
Figure 7:
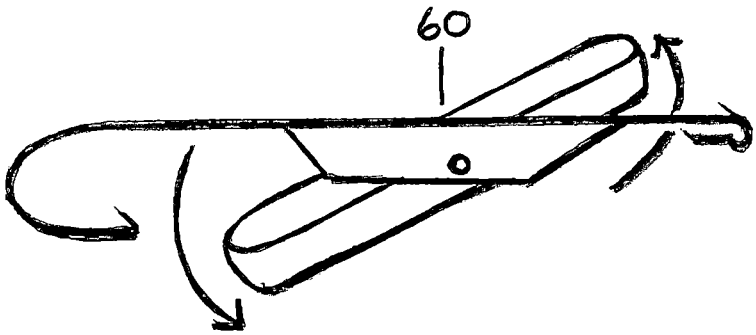
FIG. 7 shows a side view of the assembled structures depicted in FIG. 5A and FIG. 3 showing the swivel of the fashioned aluminum cylinder in a slanted position were it completed and attached to an extension ladder in any up right ladder angle.

These two separate side mounts should be made or fashioned to weld to the circular aluminum cylinder exactly with a 1 inch separation distance. Once these two mounts are welded with the 1 inch separation of the mounts from the cylinder, this will allow the sections of the mounts with the ⅝ inch hole to align flush with the side fold tabs (12) as shown in FIG. 2 and FIG. 3. Smooth out the rough welded areas. Once these mounts are welded correctly and with necessary separation then FIG. 5A will be complete. Completed, this cylinder (50) will be attached to the folds tabs (12) as depicted in FIG. 6, with two stainless steel binding posts (27) measuring ½ inch barrel diameter, with 7/16 in barrel length, with a ⅜ inch barrel depth and two binding screws (28), thread length ⅜ inches as shown in FIG. 5B, through the apertures (13) in the fold tabs (12).

The frame depicted in FIG. 8A, is made of 5/16 inch thick HIGH-STRENGTH-STEEL or CAST STEEL rod, not cold rolled. This steel rod is to be fashioned, folded and bent as shown in this FIG. 8A. The total length of this rod should be 57 inches, to complete folds and bends of this for this invention. The first bend should begin at 23⅝ inches, by making a 45 degree bend. For the next bend measure over 9¾ inches and make the same 45 degree bend. This will create the 9¾ inch horizontal back and about 23⅝ inches forming extension rods (31,32) on each opposite side of the 9¾ inch horizontal back to finish the additional bends for this FIG. 8A.

On each remaining side with the horizontal 9¾ inch back pushed away from you and with both extending rods (31,32) extended towards you begin to make your bends. Measure 14 1/7 inches from the horizontal 9¾ inch back, then make an oblique bend downward. Do this oblique bend to both extended rods (31,32). Once both (sides) rods are bent downward 7½ inches, make a 1 inch bend to the right on each extended rod. From this 1 inch right bend, make an upward bend of 7½ inches. Make this 7½ inch upward bend on the opposite extended steel rod, with the extended steel rod still extended towards you, make a backwards bend on each rod about 1¼ inches. When these 1¼ inch backwards bends are complete, on each extended steel rod make a final downward bend, and squeeze the folds close together. All these bends are illustrated in the drawing of FIG. 8A.

Finally with all the bends made in FIG. 8A, the steel support rod (40) should be welded about 12 inches from the horizontal 9¾ inch U back of the steel rod (30). This steel support rod (40) should be a measurement of about 9⅛ inches before being welded to the extending rods (31,37) as shown in FIG. 9. With the steel rod-(30) complete with the support rod (40), the 9¾ inch horizontal back of the frame (30) should be secured within end fold (15), with the allowable 1 1/7 inch end fold allowing for movement of the steel rod (30) before permanent welding of the 1½ inch fold (15).

I claim:

1. A self-leveling paint can holder comprising:

a sheet having an upper planar surface, a lower planar surface, first and second ends opposite to one another, first and second edges, a first side fold tab extending from the first side edge and a second side fold tab extending from the second edge, a cutout is contained within a central portion of the sheet, wherein the first end is bent downwardly with respect to the upper planar surface to form a first hooked end, the second end is bent downwardly with respect to the upper planar surface to form a second hooked end, and the first and second side fold tabs are each bent downwardly with respect to the upper surface to form mounting flanges;

a cylindrical portion defined by a first circumferential edge, a second circumferential edge and an annular sidewall, the first circumferential edge comprising a first groove and an opposing second groove, first and second side mounts mounted on opposite sides of the annular sidewall, each side mount having a respective mount hole;

a rod bent into a substantially U-shaped frame comprising two substantially parallel segments connected together by a third linear segment, and first and second ends of the rod being bent to form respective hooked ends;

wherein the side mounts of the cylindrical portion are respectively pivotably mounted to the first and second side fold tabs so the cylindrical portion can rotate within the cutout of the sheet;

wherein the second hooked end of the sheet receives and pivotably retains the third linear segment of the rod;

wherein the first hooked end of the sheet is configured to mount to a step of a ladder, and the hooked ends of the rods are configured to mount to a second step of the ladder;

wherein the cylindrical portion is configured to receive a gallon paint can and the first and second grooves of the cylindrical portion are configured to support handle lugs of the paint can, such that if the ladder is angled the paint can will be retained in a level orientation by the paint can holder.

2. The self-leveling paint can holder as set forth in claim 1, wherein the cutout is oval-shaped.

3. The self-leveling paint can holder as set forth in claim 1, wherein the sheet, and the cylindrical portion are made from aluminum.

4. The self-leveling paint can holder as set forth in claim 1, wherein the first and second mounts are welded to the annular sidewall.

5. The self-leveling paint can holder as set forth in claim 4, wherein the first and second side fold tabs each comprise a respective mount hole, the respective mount holes of the first and second side fold tabs are aligned with the respective mount holes of the first and second side mounts and attached with fasteners to allow pivoting of the cylindrical portion.

6. The self-leveling paint can holder as set forth in claim 5, wherein the respective mount holes of the first and second side mounts, and the first and second grooves are intersected by a common plane.

7. The self-leveling paint can holder as set forth in claim 1, wherein the rod comprises a support rod connected between the two substantially parallel segments, and spaced from the third linear segment.

8. The self-leveling paint can holder as set forth in claim 1, wherein after the third linear segment is received within the second hooked end of the sheet, the second end of the sheet is welded.

* * * * *